US011530887B2

(12) United States Patent
Mooney et al.

(10) Patent No.: US 11,530,887 B2
(45) Date of Patent: Dec. 20, 2022

(54) TOOL-LESS GUIDE ROD

(71) Applicant: Agile Ventures, LLC, Flatrock, NC (US)

(72) Inventors: Gregory Mooney, Flatrock, NC (US); Vance Bowler, Roy, UT (US)

(73) Assignee: Agile Ventures, LLC, Flatrock, NC (US)

( * ) Notice: Subject to any disclaimer, the term of this patent is extended or adjusted under 35 U.S.C. 154(b) by 0 days.

(21) Appl. No.: 17/559,073

(22) Filed: Dec. 22, 2021

(65) Prior Publication Data

US 2022/0196352 A1 Jun. 23, 2022

Related U.S. Application Data

(60) Provisional application No. 63/129,002, filed on Dec. 22, 2020.

(51) Int. Cl.

| | |
|---|---|
| ***F41A 3/86*** | (2006.01) |
| ***F41A 3/04*** | (2006.01) |
| ***F41A 25/12*** | (2006.01) |

(52) U.S. Cl.

CPC ..... *F41A 3/86* (2013.01); *F41A 3/04* (2013.01); *F41A 25/12* (2013.01)

(58) Field of Classification Search

CPC ..... F41A 3/78; F41A 3/82; F41A 3/86; F41A 11/00

See application file for complete search history.

(56) References Cited

U.S. PATENT DOCUMENTS

| | | | | | |
|---|---|---|---|---|---|
| 2,476,328 | A * | 7/1949 | Simpson | F41A 5/18 | 89/178 |
| 2,785,605 | A * | 3/1957 | Jourdat | F41A 19/33 | 89/197 |
| 4,972,760 | A * | 11/1990 | McDonnell | F41A 3/80 | 89/196 |
| 5,309,815 | A * | 5/1994 | Moller | F41A 3/86 | 89/196 |
| 6,129,000 | A * | 10/2000 | Schmid | F41A 5/02 | 89/187.01 |
| 6,430,862 | B1 | 8/2002 | Berlin | | |
| 6,865,979 | B1 | 3/2005 | Vaid | | |

(Continued)

FOREIGN PATENT DOCUMENTS

| | | | | |
|---|---|---|---|---|
| AT | 520335 B1 * | 3/2019 | | |
| DE | 10051708 A1 * | 5/2002 | F41A 3/82 | |

(Continued)

OTHER PUBLICATIONS

Dawson. <https://www.youtube.com/watch?v=FyKlm3OI4IU>. Nov. 18, 2011. (Year: 2011).*

*Primary Examiner* — Gabriel J. Klein
(74) *Attorney, Agent, or Firm* — Wood Herron & Evans LLP

(57) ABSTRACT

Provided is a handgun recoil spring guide rod having an elongated rod body configured to fit within a compression recoil spring. An axially elongated slot is formed transversely through the body and a blocking member that is configured to fit entirely within the slot and pivotably movable between a first position entirely within the slot and a second position partially protruding from the slot, such that it engages the recoil spring to hold the spring in a more compressed condition.

2 Claims, 4 Drawing Sheets

(56) References Cited

U.S. PATENT DOCUMENTS

| | | | | |
|---|---|---|---|---|
| 7,140,141 | B2 | 11/2006 | Vaid | |
| 7,240,450 | B2 | 7/2007 | Shober | |
| 8,640,375 | B2 | 2/2014 | Ketchum | |
| 9,587,896 | B1 * | 3/2017 | Huang | F41A 35/06 |
| 10,317,155 | B2 | 6/2019 | Adamietz, Jr. | |

FOREIGN PATENT DOCUMENTS

| | | | | |
|---|---|---|---|---|
| DE | 102004055862 | B3 * | 1/2006 | F16F 1/128 |
| FR | 2507302 | A1 * | 12/1982 | |
| GB | 422231 | A * | 1/1935 | |

* cited by examiner

TOOL-LESS GUIDE ROD

CROSS REFERENCES TO RELATED APPLICATIONS

This application is a Nonprovisional application claiming priority to U.S. Provisional Patent Application 63/129,002, filed Dec. 22, 2020, the full disclosure of which is incorporated herein by reference.

TECHNICAL FIELD

This invention relates to a handgun and more particularly to an accessory to be used on a Model 1911-pattern handgun to aid in the disassembly and reassembly thereof.

BACKGROUND

Handguns must be disassembled from time to time for routine maintenance and periodic cleaning. In a semi-automatic pistol, this entails removing the slide assembly from the frame. In a Model 1911 pattern handgun, it requires removing a barrel pin from the frame while the slide is in a partially retracted position. In order to then remove the recoil spring and guide rod assembly from the slide, the spring must be held in a compressed condition. Various tools have been created to facilitate this, including what may be the simplest: compressing the spring and then inserting a small wire or bent paperclip into a small transverse hole formed in the guide rod near a midpoint. But even this method requires having available some additional item to use as a tool.

A tool-less guide rod is available from Dawson Precision, Inc. of Florence Tex. (http://dawsonprecision.com). The Dawson guide rod includes a lever mounted in a longitudinal trough formed in the guide rod. The lever pivots at a midpoint and, when the forward end is depressed against a spring, a rearward end of the lever is raised to block the recoil spring guide plug and compressed recoil spring. This device functions well, but is expensive to manufacture because it requires precision machining and skill to assemble, and could accumulate difficult-to-remove debris in the trough under the teeter-totter lever.

SUMMARY OF THE INVENTION

The present invention provides a handgun recoil spring guide rod having an elongated rod body configured to fit within a compression recoil spring. An axially elongated slot is formed transversely through the body and a blocking member that is configured to fit entirely within the slot and pivotably movable between a first position entirely within the slot and a second position partially protruding from the slot, such that it engages the recoil spring to hold the spring in a more compressed condition.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
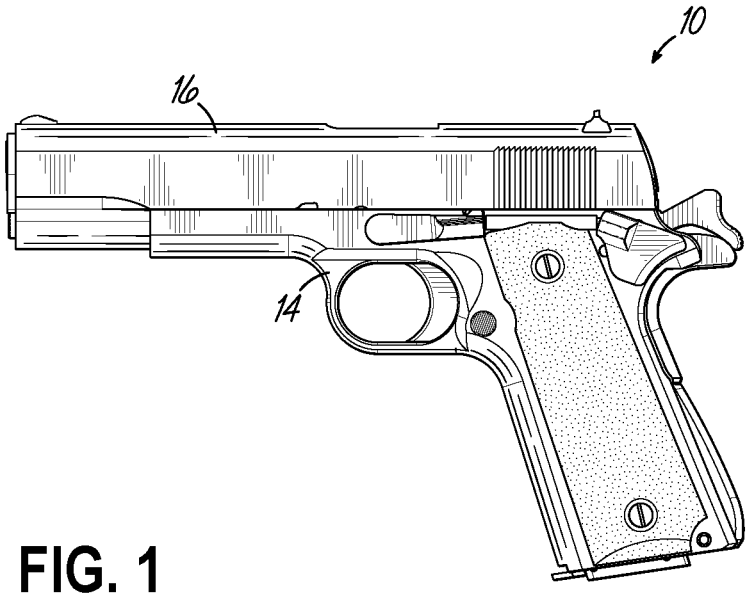
FIG. 1 is a side view of an assembled Model 1911 pattern handgun in accordance with one embodiment of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" indicates the direction of the muzzle and the direction in which projectiles are fired, while "rearward" indicates the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

Figure 2:
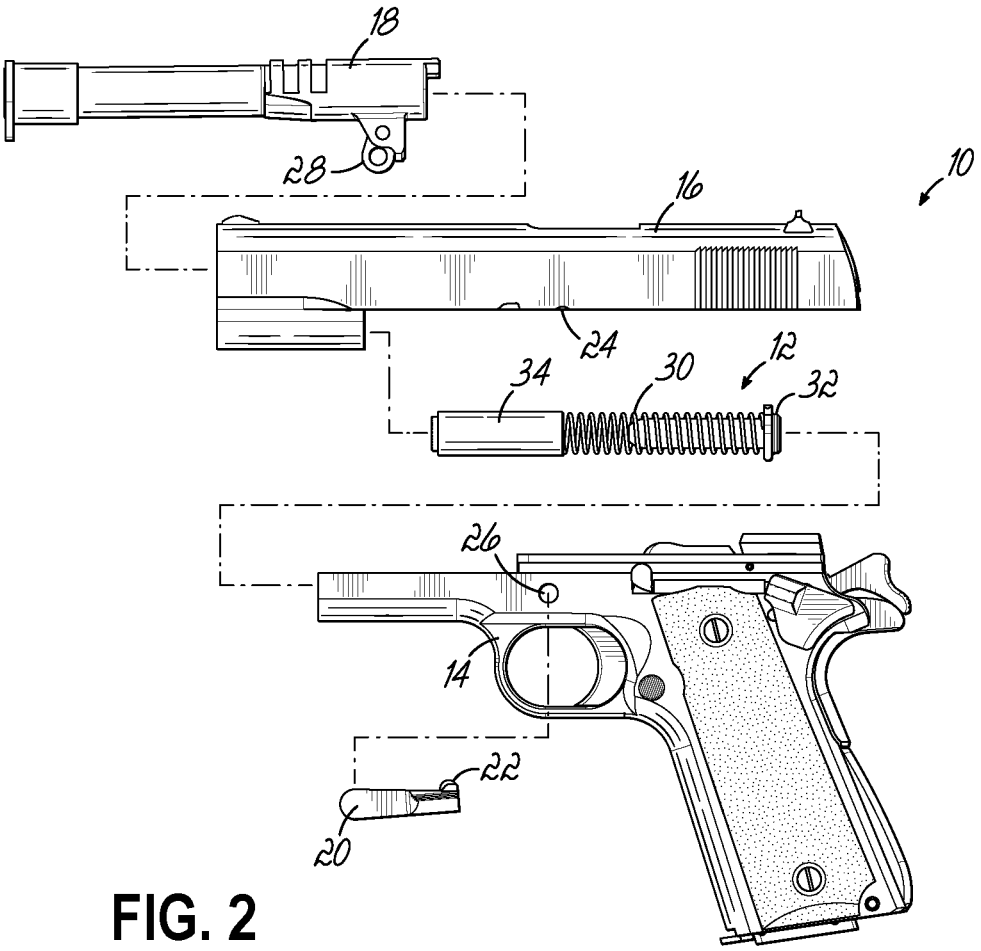
FIG. 2 is an exploded side view thereof showing the separated barrel, slide, recoil spring assembly, frame, and barrel pin/slide lock.
Figure 3:
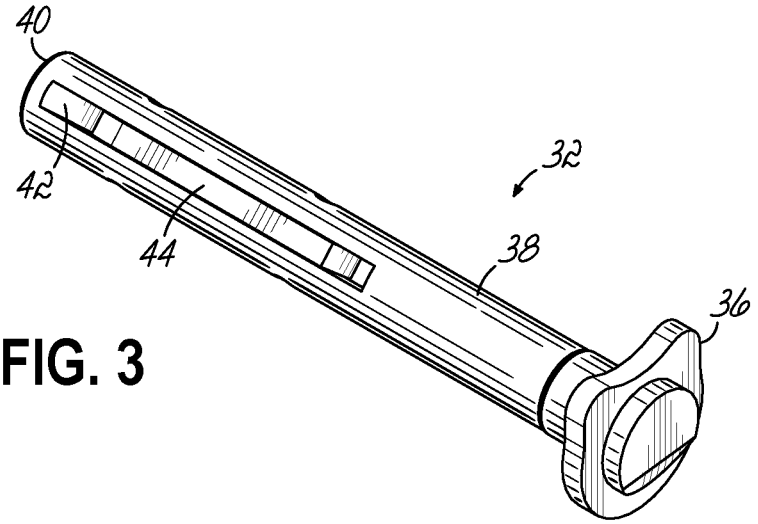
FIG. 3 is a first isometric view of a tool-less guide rod according to an embodiment of the present invention.
Figure 4:
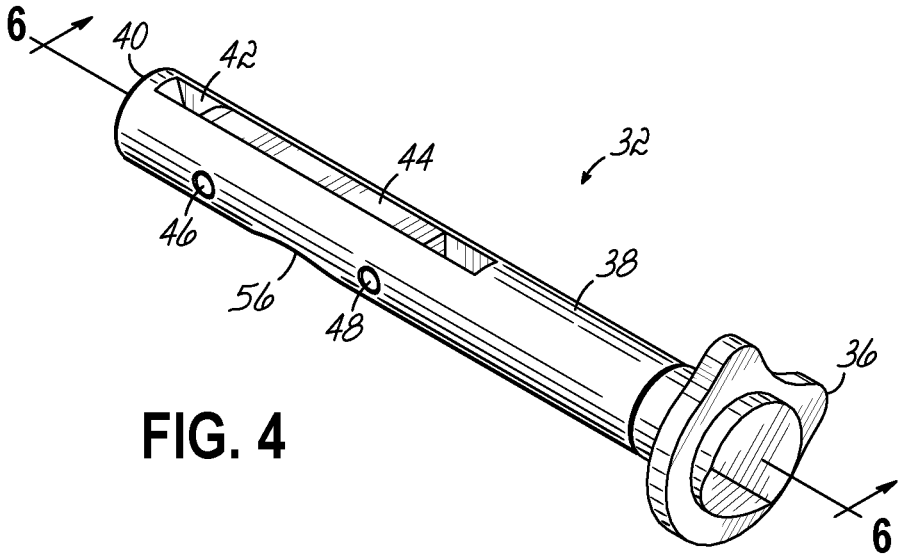
FIG. 4 is a similar view axially rotated to better see the blocking member shown in a retracted position.
Figure 5:
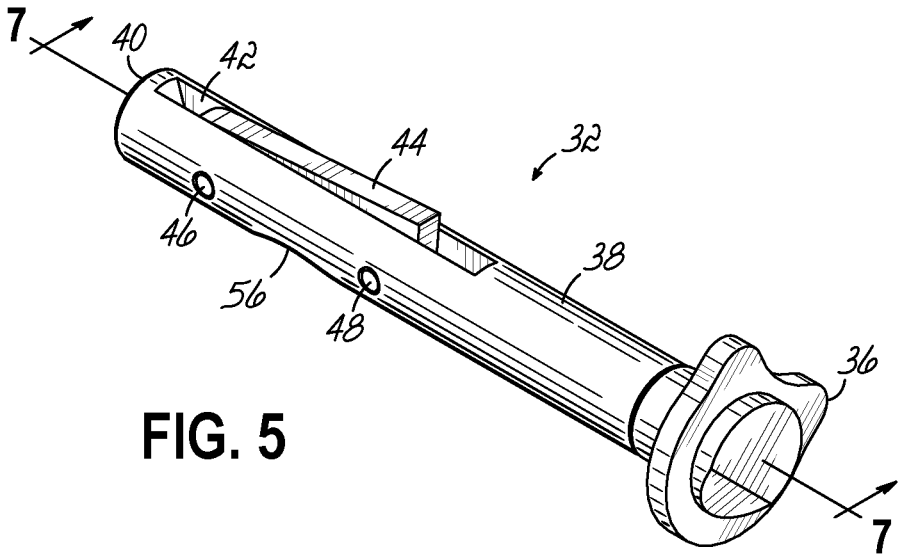
FIG. 5 is a similar view showing the blocking member in an extended position.

Referring first to FIGS. 1 and 2, therein is shown a semi-automatic handgun (pistol) 10 with a tool-less guide rod assembly 12 according to one embodiment of the present invention. The pistol 10 includes a frame 14, a slide 16, a barrel 18, and a barrel pin/slide lock member 20. The illustrated pistol 10 is an M1911-pattern handgun to which the present invention is particularly, though not exclusively, relevant. As is well-known, to field strip or partially disassemble the pistol 10, the slide 16 is partially retracted until the engagement tooth 22 of the barrel pin 20 is aligned with a disassembly notch 24 on the slide 16. This allows the barrel pin 20, which extends through opposite assembly openings 26 on the frame 14 and an opening in a pivoting link 28 on the barrel 18, to be removed. This allows the slide 16, barrel 18, and guide rod assembly 12 to slide forward and be separated from the frame 14. This, however, leaves the recoil spring 30 and guide rod 32 difficult to remove from or reassemble into the slide 16. If the recoil spring 30 and recoil spring guide plug 34 are first secured in a compressed condition prior to removing the slide 16 from the frame 14, removal of the guide rod assembly 12 and barrel 18 from the slide 16 can be done with ease.

Various tools have been constructed to secure the recoil spring 30 in a compressed condition prior to removing the slide 16 from the frame 14. Referring now to FIGS. 3-7, therein is shown a tool-less blocking guide rod 32 according to an embodiment of the present invention. The guide rod 32 includes an aft end 36 which is shaped to engage an underside of the barrel 18 and against the barrel link 28. The guide rod 32 includes a shaft portion 38, the length of which is determined by the barrel length and whether it is intended to provide "full length" guidance, to a forward end 40 thereof. An axially elongated longitudinal cut 42 extends transversely through the shaft 38 and receives a blocking member 44 that is mounted on a pair of transverse assembly pins 46, 48 extending through opposite transverse openings in the shaft 38.

Figure 6:
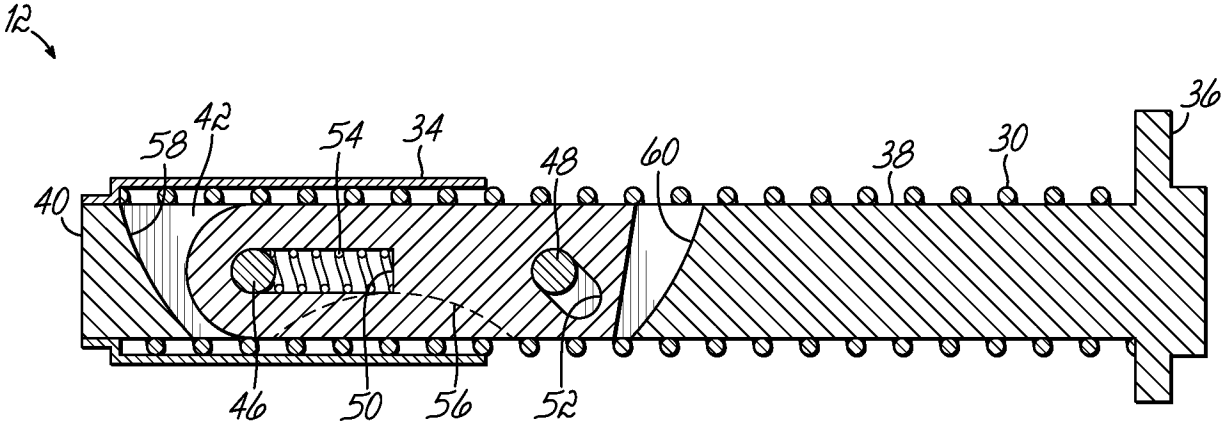
FIG. 6 is a side longitudinal sectional view taken substantially along line 6-6 of FIG. 4 and showing the recoil spring and recoil spring plug assembled thereon.
Figure 7:
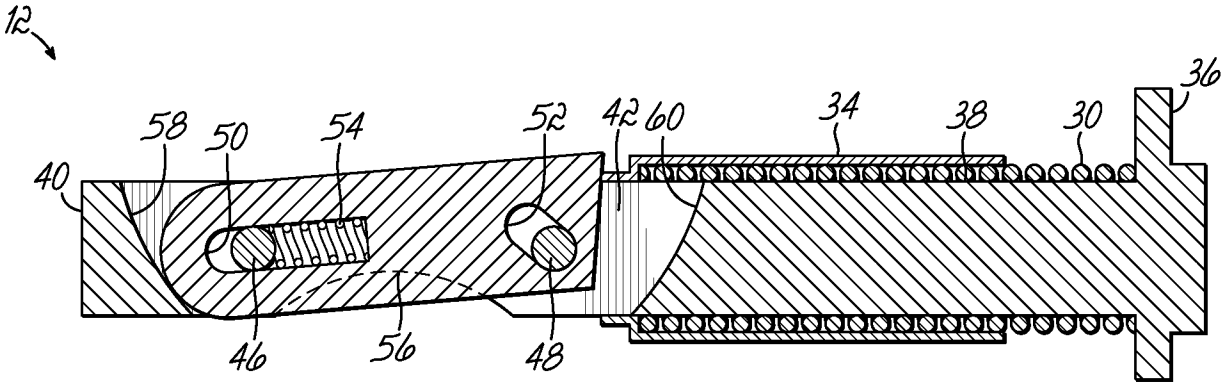
FIG. 7 is a similar view taken substantially along line 7-7 of FIG. 5 showing the blocking member in the elevated position with the recoil spring compressed.

As can be seen in FIGS. 6 and 7, the forward and rear boundaries 58, 60 of the elongated cut 42 do not need to be exactly transverse to the axis of the shaft 38. Thus, the elongated cut 42 can be formed in a single machining function with a rotary cutter, for example. The blocking member 44 can be a generally flat and elongated bar that will fit completely within the confines of the longitudinal slot 42. Referring now also to FIGS. 6 and 7, the blocking member 44 includes two openings 50, 52, which may be elongated. The first slot 50 longitudinally extends substantially along the axial direction of the blocking member 44 and receives the forward transverse pin 46. When retracted, the pin 46 rests at the forward end of the opening 50. A spring means, such as the illustrated coil spring 54, fits within the remaining length of the opening 50 and between inner wall of the longitudinal cut 42. The second elongated opening 52 can extend diagonally relative to the longitudinal axis of the blocking member 44 and shaft 38 and receives the rear transverse pin 48. The spring 54 biases the blocking member toward the rear (FIG. 6) and the orientation of the second elongated opening 52 causes the member 44 to recede into the confines of the longitudinal cut 42 within the cross-sectional profile of the shaft 38.

Because the longitudinal cut 42 extends all the way through the shaft 38, the blocking member 44 can be pressed on the opposite side against the bias of the spring 54 to the raised or blocking position (FIG. 7). A finger recess cut 56 can be provided to facilitate this, if desired. When pressed laterally, the blocking member 44 slides to an extended or blocking position. The angle of the second elongated opening 52 causes the member 44 also to be displaced longitudinally, compressing the spring 54. When the recoil spring guide plug 34 is pressed against the extended portion of the blocking member 44 by the recoil spring 30, it holds the blocking member 44 in position by biasing it against the rear transverse pin 48 and compressing the spring 54. When the force of the recoil spring 30 and/or the recoil spring plug 34 is removed, the blocking member 44 returns to its retracted position (FIG. 6), as the spring 54 causes the angled second elongated opening 54 to slide along the rear transverse pin 48.

Figure 8:
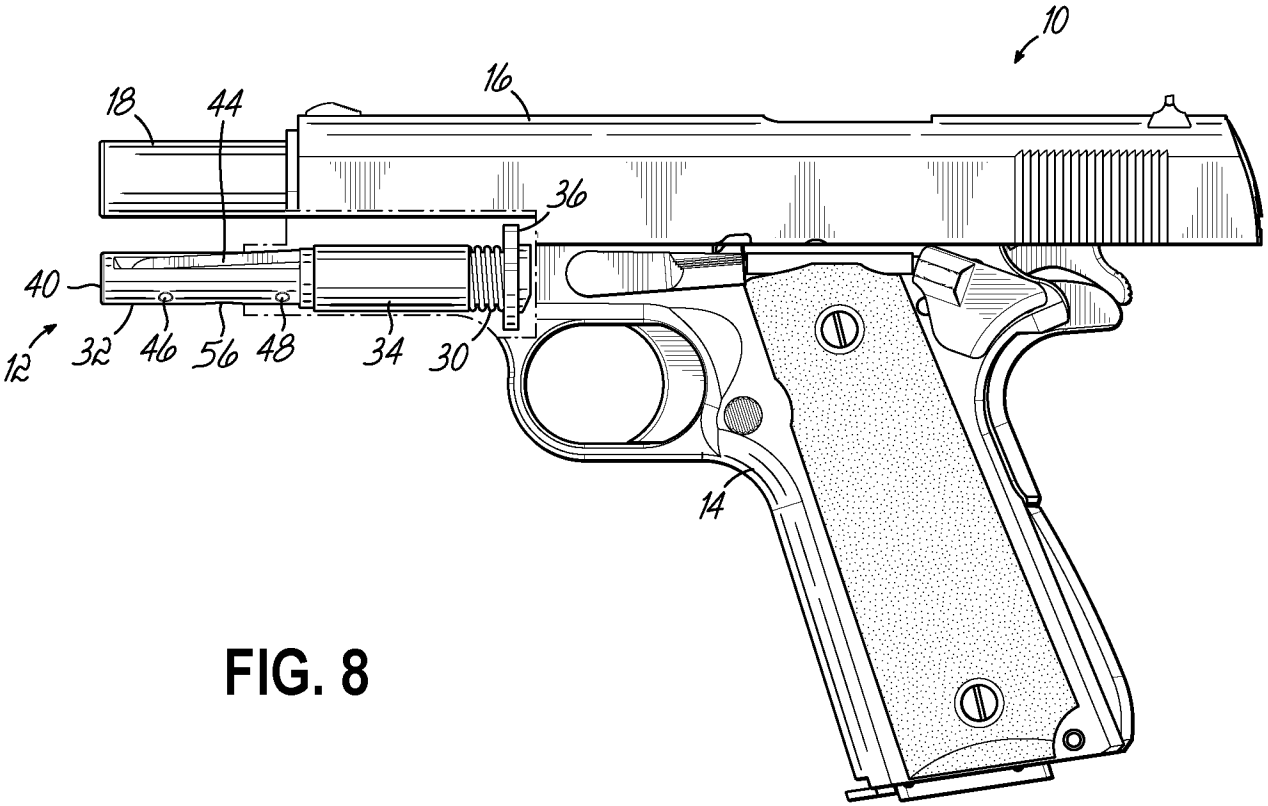
FIG. 8 is a partially cut-away side view of a pistol with the slide partially retracted and showing a tool-less guide rod according to an embodiment of the present invention employed therein.

Referring now to the cut-away view of FIG. 8, it can be seen how the blocking member 44 of the tool-less guide rod 32 holds the recoil spring 30 in a compressed condition during disassembly of the slide 16 from the frame 14.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A handgun recoil spring guide rod, comprising:

an elongated rod body configured to fit within a compression recoil spring;

an axially elongated slot formed transversely through the body; and a movable member mounted on a first assembly pin extending transversely through the slot and through a corresponding opening in a forward portion of the movable member, the movable member configured to fit substantially entirely within the slot and pivotably movable between a first position substantially entirely within the slot and a second position partially protruding from the slot such that it engages the recoil spring to hold the spring in a more compressed condition, the movable member including a forward pivot opening that receives the first assembly pin and a rearward opening that receives a second assembly pin and is shaped to allow a rearward end of the movable member to pivot to the second position, the forward pivot opening being elongated in a longitudinal direction and the rearward opening being elongated in an angled direction to guide the movable member to the second position when pivoted substantially about the first assembly pin; and further comprising a spring in the forward pivot opening biasing the movable member toward the first position.

2. The guide rod of claim 1, further comprising a finger recess formed in the rod body exposing a position of the movable member and configured to allow manual movement of the movable member from the first position to the second position.

* * * * *